US005253593A

United States Patent [19]

Kurtz et al.

[11] Patent Number: 5,253,593

[45] Date of Patent: Oct. 19, 1993

[54] TUB/CENTER SILL ATTACHMENT FOR GONDOLA CAR

[75] Inventors: William E. Kurtz, Johnstown; Kerry L. Sauter, Sidman, both of Pa.

[73] Assignee: Johnstown America Corporation, Chicago, Ill.

[21] Appl. No.: 949,975

[22] Filed: Sep. 24, 1992

[51] Int. Cl.[5] ..... B61D 9/08

[52] U.S. Cl. ..... 105/406.1; 105/355; 105/409; 105/410; 105/411; 105/422

[58] Field of Search ..... 105/406.1, 409, 410, 105/244, 245, 246, 243, 404, 413, 414, 416, 422, 238.1, 355, 411

[56] References Cited

U.S. PATENT DOCUMENTS

| | | | |
|---|---|---|---|
| 728,800 | 5/1903 | King | 105/414 |
| 882,638 | 3/1908 | Irwin | 105/414 |
| 983,263 | 2/1911 | Becker | 105/414 |
| 1,851,486 | 3/1932 | Blackhall et al. | 105/414 |
| 3,713,400 | 1/1973 | Teoli | 105/406 R |
| 4,212,252 | 7/1980 | Hart et al. | 105/406 R |
| 4,236,459 | 12/1980 | Teoli | 105/406 R |
| 4,254,714 | 3/1981 | Heap | 105/406 R |
| 4,306,505 | 12/1981 | Zehnder et al. | 105/406 R |
| 4,331,083 | 5/1982 | Landregan et al. | 105/406 R |
| 4,361,097 | 11/1982 | Jone et al. | 105/244 |
| 4,408,542 | 10/1983 | Heap | 105/406 R |
| 4,633,787 | 1/1987 | Przybylinski et al. | 105/406.1 |
| 4,911,082 | 3/1990 | Richmond | 105/406.1 |

*Primary Examiner*—Mark T. Le

[57] ABSTRACT

An attachment for attaching the ends of concave floor panels of a gondola car to the center sill by a plate extending through the vertical cover plate of the floor panels and being affixed to the floor panels and to the center sill. The plate includes a curved contour adjacent the concave floor panels and is affixed by lock bolts to both the floor panels and to the center sill. Angle members affix the vertical cover plates to the ends of the concave floor panels.

15 Claims, 1 Drawing Sheet

TUB/CENTER SILL ATTACHMENT FOR GONDOLA CAR

BACKGROUND OF THE INVENTION

1. Field of the Invention

This invention relates in general to gondola rail cars and more particularly, to the attachment of the center sill of a gondola car to its concave floor panels, often referred to as tubs.

2. Summary of the Prior Art

Gondola rail cars are commonly used to carry bulk materials, such as coal, sand, gravel or the like. One type of gondola car employs concave floor panels which significantly increase the load carrying volume of the car beneath the center sill. An example of a railway gondola car having concave floor panels is disclosed in U.S. Pat. No. 4,361,097 issued Nov. 30, 1982 to Jones et al. The gondola car shown in the Jones et al patent includes concave floor panels disposed on each side of the center sill to form longitudinally extending tubs which extend beneath the center sill for increased capacity. The double tubs of the foregoing Jones et al patent are affixed at their inner edges by welds or rivets to the center sill. During operation of such prior gondola cars, the stresses imposed upon the center sill are transmitted to the concave floor panels to cause potential fatigue cracking of the tub material over a period of time. Accordingly, it is desirable to provide an improved technique by which the tubs are attached to the center sill to minimize the occurrence of fatigue cracking.

SUMMARY OF THE INVENTION

It is therefore an objective of the invention to provide an improved attachment of the tub or trough of a gondola car to the center sill. In addition, the invention provides improved attachment members for affixing the ends of the tub to its end closures to further reduce fatigue failure. In accordance with the invention, the attachment members of the invention affixing the enclosures to the ends of the tubs are more efficient and economical than prior manufacturing techniques employing welds and the like. The center sill to tub attachment of the invention includes plate means that attach to the concave floor panels, extend through the end closures and attach to the center sill. The plate means possesses an unique configuration that allows the stresses of the center sill to be more widely distributed into the tub material and prevent fatigue cracking in the floor panels. The foregoing attachment means of the invention can easily be fabricated and installed in existing gondola cars as a retrofit.

DESCRIPTION OF THE PREFERRED EMBODIMENT

Figure 1:
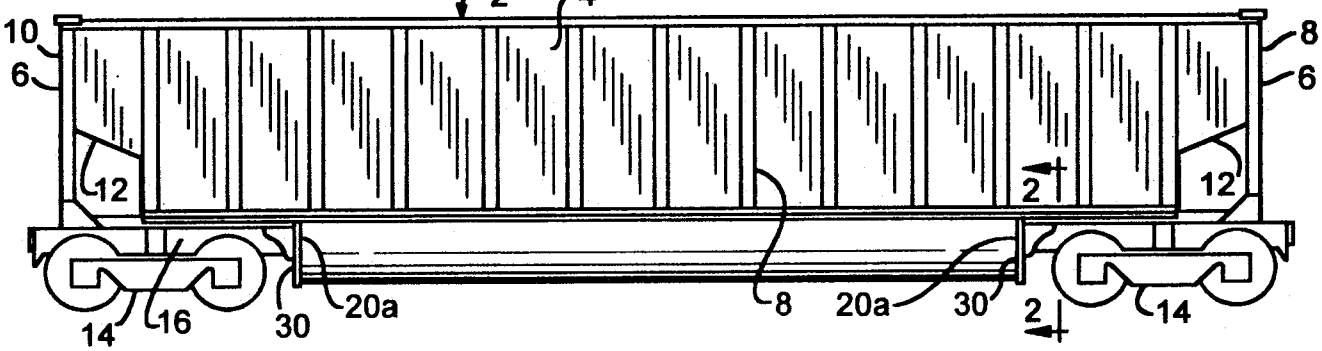
FIG. 1 is a side elevational view of a gondola rail car for carrying commodities and having concave floor sections in the form of tubs.

Referring to FIG. 1, there is illustrated a gondola-type rail car for carrying commodities, such as bulk materials in the form of coal, sand, gravel and the like, and generally designated by reference numeral 2. The outward appearance of the gondola car 2 is similar to the railway gondola cars shown in U.S. Pat. No. 4,361,097 to Jones et al to which specific reference is made herein. It should be understood, however, that the invention of the application is not limited to the particular construction of the gondola car in the Jones et al patent and can be employed in conjunction with other rail cars having concave floor sections on which fatigue problems exist in the tubs due to the stresses imposed on the center sill.

Figure 2:
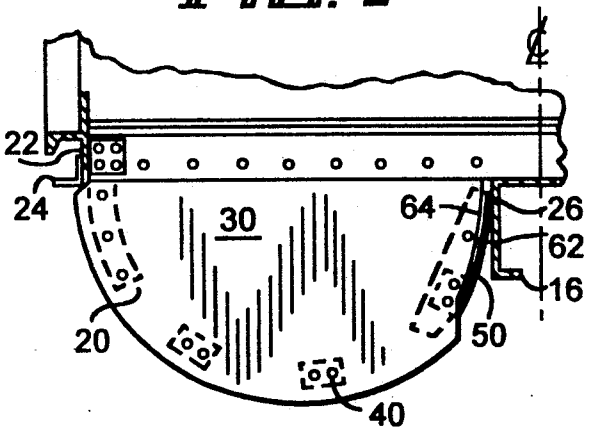
FIG. 2 is a partial end elevational view, with parts and section, taken along lines 2—2 of FIG. 1.

The gondola car 2 of FIG. 1 includes a pair of vertical side walls 4 and a pair of end walls 6. The side walls 4 are stiffened by a plurality of vertical stiffeners 8. The end walls 6 have upper vertical portions 10 and lower portions 12 which extend over conventional car trucks 14 and distribute portions of the end loading. A center sill 16 having a box beam shape extends substantially the full length of the car 2 between the trucks 14 and provides the support structure for concave floor panels 20 in the form of a pair of tubs extending longitudinally on each side for a substantial length along the center sill 16. One of the longitudinally extending tubs 20 is shown in FIG. 2. It should be apparent that a similar tub 20 is supported on the opposite side of the center sill 16 in parallel relationship to the floor panels shown in FIG. 2. The pair of tubs 20 are affixed along outer edge portions 22 to the longitudinal stiffeners 24 of the pair of side walls 4 as further shown in FIG. 2. The inner edges 26 of the tubs 20 forming the concave tubs are welded or riveted to a respective side of the center sill 16.

Figure 4:
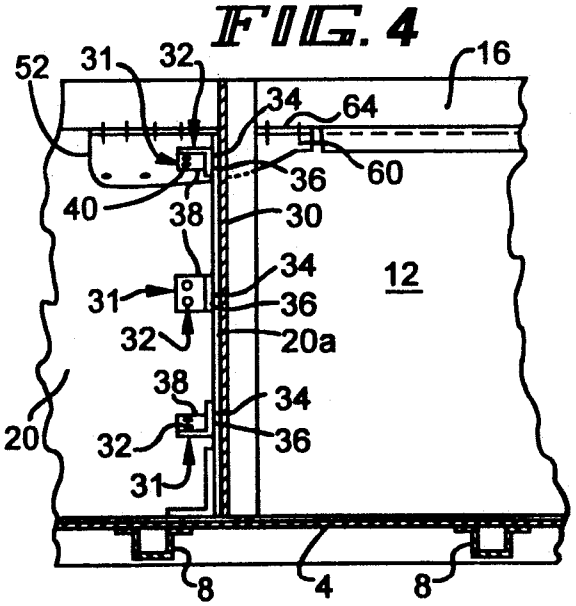
FIG. 4 is a top partial plan view, with parts in section, taken along lines 4—4 of FIG. 3.
Figure 3:
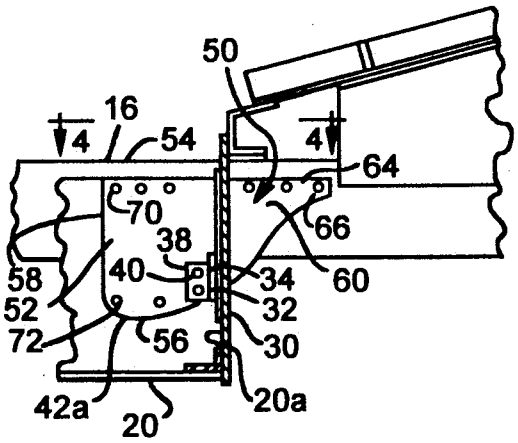
FIG. 3 is a partial side elevational view, with parts in section and parts broken away, of the attachment means of the gondola car of FIG. 1.

The open ends 20*a* of the tubs 20 are enclosed by semicircular, vertical cover plates 30 and are affixed to the ends of the tubs 20 by unique attachment members 31 of the invention. The vertical cover plates 30 are affixed to the ends of the tubs 20 by a plurality of metal angle members 32 as best shown in FIGS. 3 and 4. Although it is within the scope of the invention to use other number of attachment members, three angle members 32 are shown to attach the vertical cover plates 30 at each end of the tubs 20 on both sides of the center sill 16. Each angle member 32 includes a first angle portion 34 having a surface contacting the inside face of the vertical cover plate 30. A plurality of lock bolts 36 affix portion 34 to the vertical end plate 30. A second portion 38 of angle member 32 is disposed at generally right angles to first portion 34 and possesses a contour approximately corresponding to the contour of the concave tubs 20. A plurality of lock bolts 40 attach second portion 34 to the end structure of the tubs 20. Such a attachment technique eliminates the necessity of aluminum welding relied upon in the prior art to attach the vertical cover plates 30 to the tub 20. The angle members 32 minimize fatigue on the tub structure previously occurring as a result of welding attachment.

Referring now to FIGS. 2 to 4, there is illustrated the improved attachment bracket 50 of the invention for affixing the end portion of the tubs 20 to the center sill 16 at both ends. Each attachment bracket 50 comprises a plate having a tub attachment portion 52. The tub attachment portion 52 is formed with a straight upper edge 54, a lower convex curved configuration 56, and a straight end edge 58. (FIG. 3). The cross section of tub attachment portion 52 has a curved contour to generally correspond to concave floor panels 20. The dimension of the tub section 52 at area 42*a* is greater in vertical height than the maximum height of the center sill section 60 of bracket 50. Center sill plate section 60 is arranged to be affixed to the center sill 16 in a manner that will later be apparent. The tub attachment portion 52 and the center sill attachment section 60 of the attachment bracket 50 are formed as a single piece extending through opening 62 in a vertical end cover plate 30. As a result the tub attachment portion 52 is situated adjacent an end portion of the tub 20 while the center sill portion 60 is situated adjacent the center sill 16 beyond the tub 20.

The center sill attachment section 60 of bracket 50 includes a upper section 64 contacting center sill 16 and is affixed thereto by three lock bolts 66. It should be noted from FIG. 3 that the width of the center sill attachment portion 60 increases in vertical height in a direction inward towards the tub 20, whereby the maximum width of attachment bracket 50 is present in the tub portion 52 of the attachment plate 50 so that the stresses from the center sill are more widely distributed over a greater area in the material of the floor panels 20. The tub portion 52 of the attachment bracket 50 of the invention is affixed at its upper edge portion to floor panels 20 and center sill 16 by a plurality of lock bolts 70, such as three in number, and at its lower portion to the floor panels 20 by lock bolts 72. It should be noted that the tub attachment bracket 50 may have a length which is greater or smaller than that shown in the figures. Longitudinal loads imposed on center sill 16 are then uniformly distributed on the concave panels 20 to resist cracking and prevent stress concentration.

What is claimed is:

1. A gondola car comprising a body being supported on a pair of truck assemblies, said body having a center sill and a pair of longitudinally extending concave floor panels longitudinally extending on opposite sides of said center sill, said concave floor panels each having a vertical end plate at each end, and an attachment plate being affixed to said center sill and to one of said floor panels, respectively on opposite sides of said vertical end plate.

2. The gondola car according to claim 1 wherein said attachment plate extends through said vertical end plate.

3. The gondola car according to claim 2 wherein said attachment plate includes a first portion disposed adjacent said concave floor panel, said first portion being affixed to said floor panel.

4. The gondola car according to claim 3 wherein said attachment plate includes a second portion disposed adjacent said center sill, said second portion being affixed to said center sill.

5. The gondola car according to claim 4 wherein said first portion and said second portion are respectively affixed to said floor panel and said center sill by bolt means.

6. The gondola car according to claim 3 wherein said attachment plate includes a curved contour to correspond to the configuration of said concave floor panels.

7. The gondola car according to claim 4 wherein said first portion includes a greater height than said second portion.

8. The gondola car according to claim 4 wherein said attachment plate includes a bottom edge having a curvilinear configuration.

9. In a rail car having a center sill and a pair of longitudinally extending concave floor panels disposed on opposite sides of the center sill comprising a support plate affixed to each end of said concave floor panels and said center sill, a vertical end plate at each end of said concave floor panels, and said support plate extending through said vertical end plate.

10. The rail car according to claim 9 wherein said support plate includes a portion having cross sectional contour conforming to the configuration of said concave floor panels.

11. The rail car according to claim 10 wherein support plate is respectively affixed to one of said concave floor panels and said center sill, at opposite sides of said vertical end plate.

12. The rail car according to claim 11 further comprising bolt means for affixing said support plate to said concave floor panel and said center sill.

13. The rail car according to claim 11 wherein said support plate has a greater height adjacent said floor panel than adjacent said center sill.

14. A method of attaching a support plate to and end of a concave floor panel of a gondola rail car and to a center sill, through a vertical cover plate comprising the steps of passing the support plate through the vertical cover plate, positioning a first portion of the support plate adjacent the concave floor panel, on a first side of the vertical cover plate, positioning a second portion of the support plate adjacent the center sill, on the opposite side of the vertical cover plate from said first side, and affixing said first and second portions respectively to the concave floor panel and the center sill.

15. The method according to claim 14 further the step of affixing said first and second portions respectively to the concave floor panel and the center sill by threaded bolt members.

* * * * *